United States Patent [19]

Yasushi et al.

[11] 4,039,303

[45] Aug. 2, 1977

[54] METHOD OF MAKING TUBULAR ABRASIVE CLOTH

[76] Inventors: Kaneko Yasushi, 1-36, 3 chome, Kamikizaki, Urawashi, Saitamaken; Tanaka Seisaburo, 5-7, 6 chome, Uematsucho, Yaoshi, Osaka, both of Japan

[21] Appl. No.: 632,505

[22] Filed: Nov. 17, 1975

Related U.S. Application Data

[62] Division of Ser. No. 450,095, March 11, 1974, abandoned.

[51] Int. Cl.[2] ..... B24D 11/02

[52] U.S. Cl. ..... 51/297; 51/403

[58] Field of Search ..... 51/297, 403, 401

[56] References Cited

U.S. PATENT DOCUMENTS

| | | | |
|---|---|---|---|
| 2,024,591 | 12/1935 | Manchester | 51/401 |
| 2,038,782 | 4/1936 | Ellis | 51/297 |
| 2,309,456 | 1/1943 | Hoskin et al. | 51/403 |

FOREIGN PATENT DOCUMENTS

| | | | |
|---|---|---|---|
| 560,413 | 7/1958 | Canada | 51/403 |
| 1,089,561 | 3/1955 | France | 51/403 |

*Primary Examiner*—Donald J. Arnold

[57] ABSTRACT

The present invention relates to an abrasive tubular structure formed of cloth or paper and particularly the construction of that tube and also the method of its manufacture. These types of abrasive tubes are used to grind plywood sheets, aluminum, stainless steel sheets, etc. for the purpose of smoothing the surface thereof. Since the sheet materials requiring smooth surfaces are increasingly large in size, then the grinding function to be effective means that the tubular abrasive cloth or paper shall be of large size and also long and thick in diameter even though precision is required.

1 Claim, 6 Drawing Figures

METHOD OF MAKING TUBULAR ABRASIVE CLOTH

This is a division of application Ser. No. 450,095 filed Mar. 11, 1974, now abandoned.

Heretofore, a large size tube is formed of abrasive cloth or paper about 300 m.m. in diameter, best shown in FIG. 1. Before producing an elongated abrasive cloth in a circle we grind the butting edges thereof in a taper and then paste and fit both faces against each other. In this type of construction it is difficult to make the pasted and abutted portions of the tube in a uniform thickness in comparison with other portions of the tube. The result thus being that when surface grinding is carried out by use of such an abrasive tube it is inevitable to make scars, so called, which are termed joint marks and which are formed on the ground material surface caused by the foregoing difference in thickness and which reflect light occuring irregularly on the surface of the ground material. The outer appearance is thus notably lost and, consequently, the value of the merchandise is decreased. In addition, as far as the tubular abrasive cloth or paper is made by a number of joint connections in a lengthwise direction, it is difficult to form a tube with the respective sections having a uniform outer shape. Also, since the connecting parts are likely to be in a formal shape whereupon such abrasive cloth or paper is mounted on the roller of a grinding machine to rotate and is likely to move sideways along the roller. This requires frequent returning of this tubular paper or cloth to a normal position by pushing aside the butting connection parts thereof to cause a hunting phenomena. The connecting parts are destroyed or deformed due to the expansion of the middle portion of the axially mounted tube and finally to weaken its strength. Notwithstanding the flat materials of the abrasive cloth or paper, are limited in size, such tubular abrasive cloth or paper have a large size as required to comply with the increasing width of the object which is to be ground.

An object of the present invention is to resolve the foregoing technical problems accompanied by providing a spirally wound core of cloth or paper then pasting at least an interlining cloth or paper as intermediate the outer periphery of said core tube and spirally winding an abrasive cloth or paper thereon with paste. This is accompanied in such a manner that both side edges of the respective cloth papers shall not overlap one on the other.

Other objects and advantages and features of the invention may appear from the accompanying drawings and the subj-joined detailed description.

IN THE DRAWING

REFERRING MORE PARTICULARLY TO THE DRAWING

Figure 1:
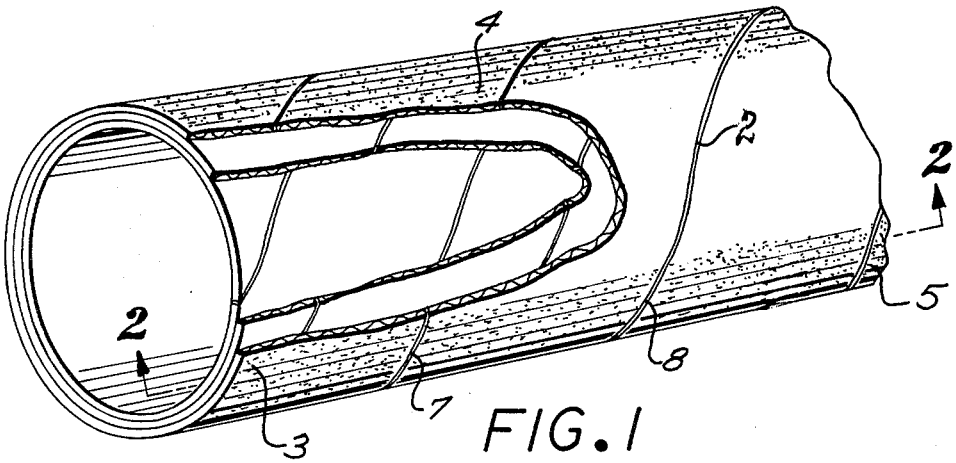
FIG. 1 is a fragmentary perspective view of a tubular abrasive cloth or paper according to the present invention.

This invention relates to a tubularly-formed abrasive cloth or paper and involving an improved construction and also the manufacture thereof. This tubular construction is formed of an abrasive material which is used in the grinding of plywood, aluminum, sta inless steel and the like in order to obtain a smooth surface. The present tendency is to increase the square size of the material which is to be worked upon. Also, the grinding function must be effectively maintained. This type of abrasive cloth or paper is much desired in the industry. A large size tubular abrasive cloth or paper over 300 mm in diameter as shown in FIG. 1 by forming an elongated abrasive cloth in a circle then grinding the butting edges faces in a taper, then pasting and fitting both faces on each other. In this construction it is difficult to make the pasted and abutted portions of the tubular cloth or paper in a uniform thickness compared with other portions of the tube. The result is that when the surface grinding occurs with the tubular abrasive cloth or paper, it is inevitable to make scars, so called. Joint marks will remain on the once ground material surface caused by the foregoing difference in thickness which reflects light in an elongated pattern. The outer appearance, therefore, is lost and the value of the merchandise is decreased. In addition, as far as the tubular abrasive cloth or paper in such construction is made by a number of joint connections in a lengthwise direction. it is difficult to form a tube with the respective sections having a uniform outer peripheral shape. Also, since the connecting parts are likely to be in a formal shape when the abrasive cloth or paper is mounted on the roller of a grinding machine, it is likely to move sideways along the roller. This requires frequent returning of this tubular shape to a normal position by pushing aside the butting connection parts thereof which cause a back and forth or hunting phenomena and a destruction of the connection parts. It also causes deformation due to an expansion of the middle portion of the axially mounted tube and finally to weaken its strength. Notwithstanding that the flat materials of abrasive cloth or paper is limited in size, such tubular abrasive cloth or paper in a large size is required to comply with the increasing width of the grinding object or materials which are to be ground. The present invention will resolve the foregoing technical problems which are accompanied by providing a spirally would tubular cloth or paper core. This is accompanied by by pasting an interlining cloth or paper as an intermediary on the outer periphery of the core tube and spirally winding an abrasive cloth or paper thereon with a paste or adhesive in such a manner that both side edges of the respective cloth or paper shall not overlap one with the other.

Figure 2:
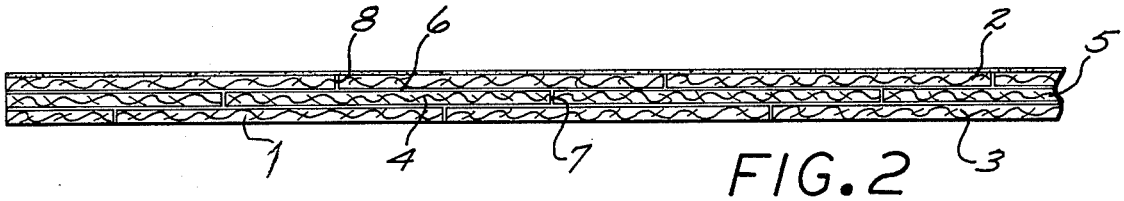
FIG. 2 is an enlarged sectional view taken on line 2—2 of FIG. 1.
Figure 3:
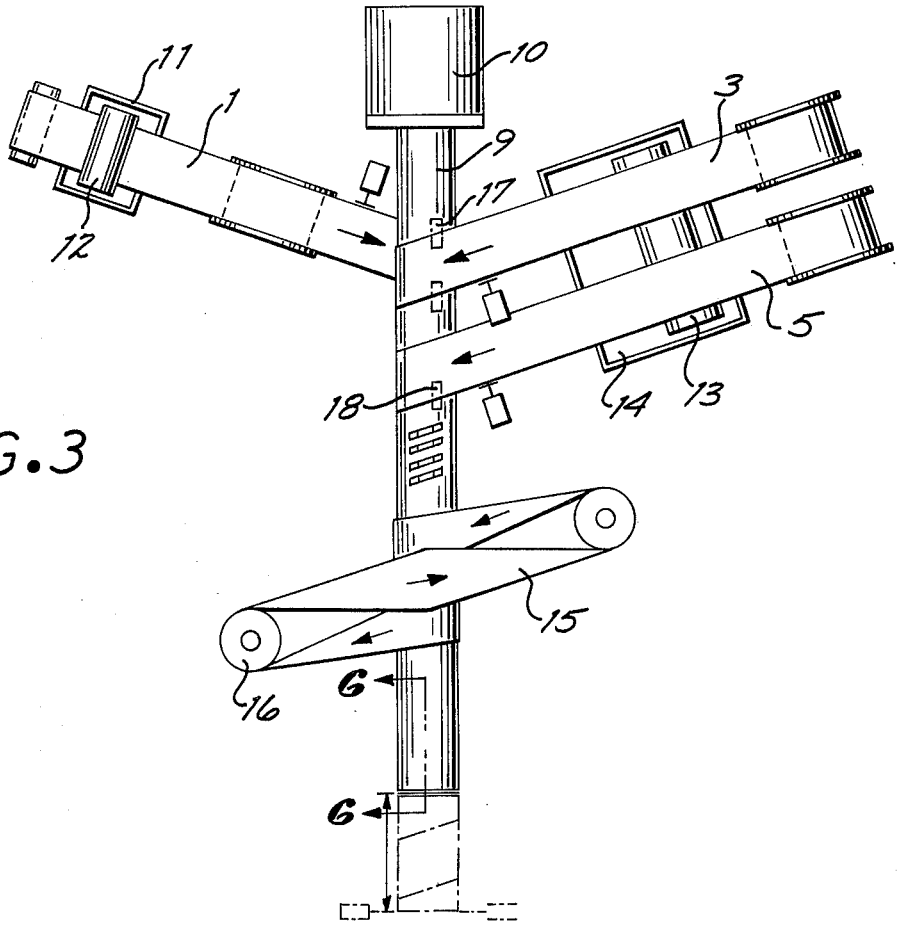
FIG. 3 is a plan view showing the entire assembly to produce the tubular abrasive cloth or paper.
Figure 4:
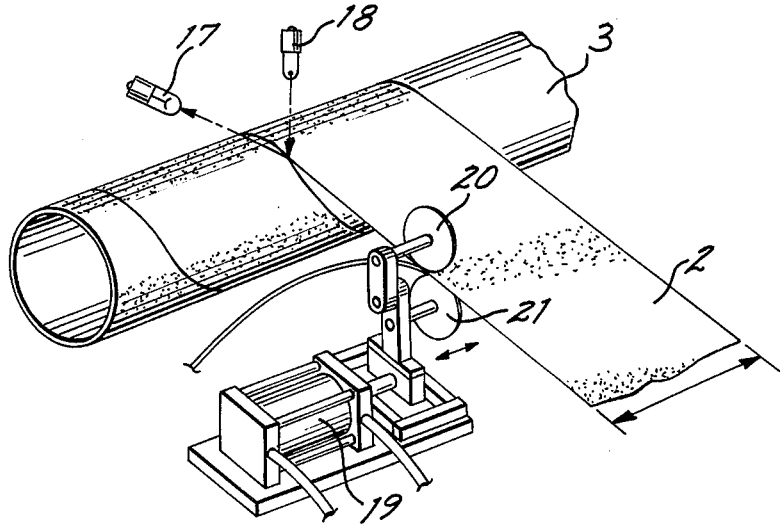
FIG. 4 is a perspective view showing an edge surplus cutting method whereby the side edges of the underbased and abrasive cloth or paper are shaped correctly.
Figure 5:
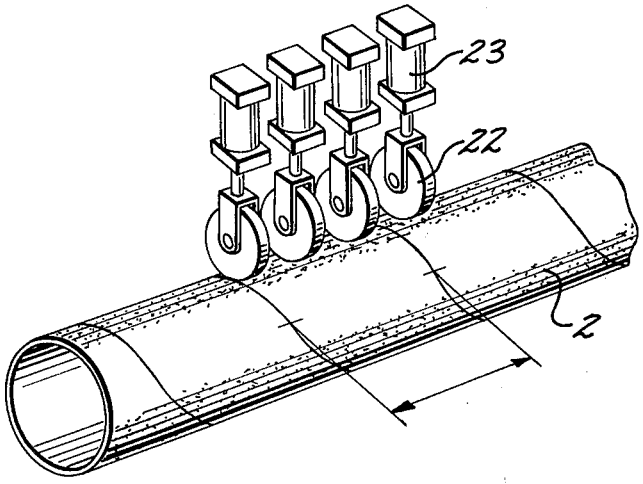
FIG. 5 is a perspective view showing a means of exerting pressure on the edges of the cloth or paper forming a tube.

The numeral 1 in FIGS. 1 and 2 indicates a core formed of cloth or paper and which is prepared by spirally winding a long belt of cloth or paper on the outer periphery of a mandrel 9 and then pulling the mandrel out. During the winding of said cloth or paper to form a core tube, both side edges 2-2 are arranged not to be overlapped one on the other so as to form a gap not over 1 mm there-between. Numeral 3 is an interlining of cloth or paper and represents a sheet of interlining cloth or paper. It is feasible to provide more than two sheets of such interlining paper. This paper is from unwoven belt cloth or synthetic resin film such as polyester film. Immediately after winding the core cloth paper 1 the interlining cloth paper 3 is spirally wound and then pasted on the adjacent line covering the periphery of said core of cloth or paper. An intermediary layer 4 of adhesive having a resilient nature, when both side edges 7-7 are adjacent not to overlap one on the other and to form a gap with the same distance as defined above. The numeral 5 is an abrasive cloth or paper the surface of which is attached by a layer of strong adhesive. Immediately after winding of the said interlining cloth or paper 3 with a paste, this abrasive cloth or paper is spirally wound on the periphery of said adjacent side edges 7 and intermediate the layer 6; of an adhesive having a resilient nature. When both side edges 8-8 are not overlapped one on the other so that they are adjacent and form a gap with the same distance as defined above. In the respective winding steps it is preferred that the respective cloth or paper 1, 3 and 5 have an approximate uniform width and are arranged offset about a space of ⅓ from each other. In order that the respective spiral adjacent lines 2, 7 and 8 may not be in alignment with each other in regard to the respective layers, in an attempt to render resilient the abrasive cloth or paper 5 which is placed in contact with the object to the ground, the core cloth or paper 1 and the interlining cloth or paper 3 are composed; of a substance which has a resilient nature. Since the present tubular abrasive cloth or paper is constructed as above, it is possible to obtain the surface of an object to be ground which object is not provided with uniform scars and not formed with so called "joint marks" as mentioned above. Even with a smooth finish without any spots thereon; moreover, a constant pressure forming contact with objects to be ground can be applied. Even in cases where the tubular abrasive cloth or paper is desired of a considerable length and large diameter (over 300 mm) the present invention affords an advantageous construction facilitating the maximum production of the desired abrasive tube with considerable ease by the method discussed as follows:

This method comprises introducing respective belts of cloth or paper on three or more tracks onto a mandrel in an oblique direction, then spirally winding the belts as shown in FIGS. 3, then pasting the respective belts or cloth or paper in a one-third offset position from each other. Then the abrasive cloth or paper strips are overlapped thereon as shown in FIGS. 4 and 5 and then propelling the mounting cloth or paper on said mandrel in the nature of a spiral. By cutting the edge surplus of said respective cloth or papers as shown in FIG. 4 and further cutting the processed product in a pre-determined length.

Figure 6:
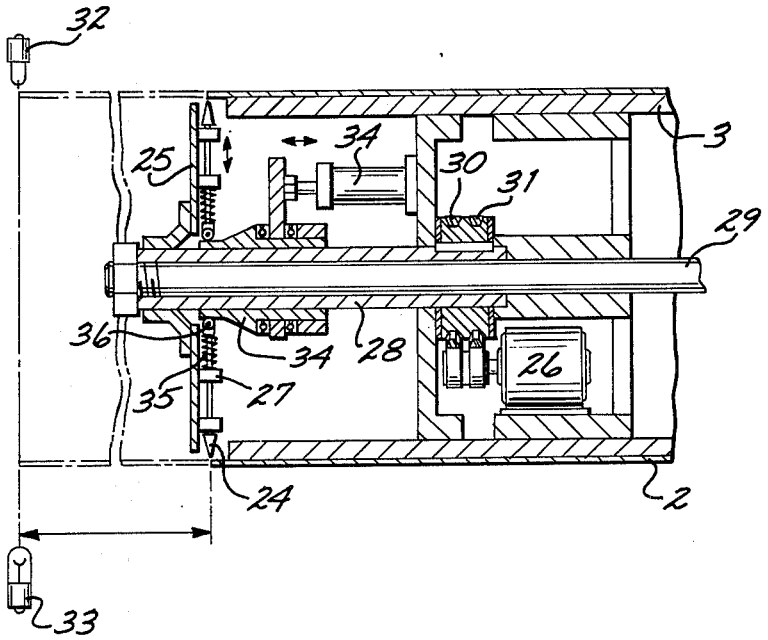
FIG. 6 is a sectional view taken on line 6—6 of FIG. 3.

The present method is as follows: In FIG. 3 the belt or cloth papers 1 and 3 are disposed in an oblique direction to a mandrel 9 extending from a bearing 10. Paraffin, oil or the like is stored in a reservoir 11 in order to decrease the friction of the inner surface by means of cloth or paper 1 to the mandrel 9. The roller 12 distributes the oil or the like to the strip 1. The inner surfaces of the cloth or paper 3 and the abrasive cloth 5 are passed over and contacted with a coating roller 13. This coating roller is supported in the reservoir 14 thereby overlapping and pasting the strips 1 and 3 to each other. The numeral 15 indicates a belt which transfers power to the tubular abrasive cloth or paper formed as recited above. Thus, overlapping and pasting and propelling the belt in the direction of the mandrel 9. A pulley 16 acts to drive the belt 15 in an oblique direction to the mandrel as shown by the arrows in FIG. 3. During every winding, pasting of the belts 1 and 3 and the roller or paper 5, it is noted that the side edges of 2, 7 and 8 may not be overlapped one on the other and that the resulting gaps may be required of less than one m.m. in view of the tendency that the gaps will be greater in the wider belt for cloth papers 1 and 3. An abrasive cloth or paper 5 is used and the greater the diameter of the formed tube the longer the part 5 will be. In addition to the evaluation in respect to the life period of the resulting tubular product which is finished after the worked upon material has been ground. In order that the belt 1 and 3 and the abrasive belt 5 may be wound and then passed neatly and tightly on each other to arrange the side edges 2 and 7 and 8 as desired. The photo-electric tubes 17 and 18 are provided to detect if the side edges are arranged as desired and to be operatively associated with an actuator 19. The actuator 19 is so tuned that when any disorder occurs occasioned by the overlapping of the belt edges, thereby the edge surplus can be cut by the upper and lower disc cutters 20 and 21 and is thus evident that the surplus alone can be removed from the belt 2 so that a determined width of the belt is provided. An adhesion between the two layers of the belts 1 and 3 and the abrasive belt 5 may be ineffective as the wider they are used and the spread of paste cannot be obtained throughout. In order to improve such adhesive effect plural rows and lines of depressed rubber rollers 22 and actuators 23 are provided to adjust pressure against each surface corresponding to the diameter of the processed tubular abrasive cloth or paper and the nature of the worked upon materials. The processed tubular abrasive cloth or paper is to be cut in a determined length to the finished product. In this case it is difficult to apply any customary cutting method at the free end portion of the mandrel 9 and in view of its tubular form and flexability. According to the present invention a plurality of knives 24 in compliance with the diameter and nature of the worked upon material, are applied and directed outwardly from the inner side of the mandrel 9 and rotated to cut as shown in FIG. 6. A disc 25 is rotated by the motor 26, the disc 25 is provided with bearings 27 through which the knives 24 are slidably supported. The disc 25 is fixed on the rotary sleeve 28 which is mounted on a fixed shaft 29 provided inside of the mandrel 28. The disc 25 is rotated by the roller 26 between the pulleys 30 and 31. When the end portion of the processed tubular cloth or paper arrives at a pre-determined position, photo-electric tubes 32 and 33 and a limit switch provided to detect this situation and thus the actuating signal operates an actuator 34 and a cam which is mounted on the rotary sleeve 28. The knives 24 are directed outwardly against the tension of the springs 35 by operation of the cam 34 which moves toward the left and a roller 36 provided under the knives 24 to engage therewith. The cutting edges are worked out to cut the processed tubular abrasive cloth or paper from the inside by the revolution of the knives 24. As explained above, the producing method according to this invention facilitates maximum production with ease and produces a product of considerable length and more than 300 mm in diameter having high precision and high strength.

We claim:

1. A method of making a tubular abrasive member that comprises the steps of:

a. providing first, second and third endless belts of a pliable sheet material, said third belt having an inner surface and an abrasive covered outer surface;

b. rotating an elongate rigid member having a circular transverse cross section;

c. sequentially applying oil to said first belt;

d. sequentially winding said first belt after said oil is applied thereto onto said rotating mandrel at a first oblique angle to form a first spiral thereon in which the edges of said first belt do not overlap;

e. applying a bonding agent to said second belt;

f. sequentially winding said second belt onto said first spiral at a second oblique angle opposite to said first oblique angle for said bonding agent to contact said first spiral and define a second spiral thereon in which the edges of said second belt do not overlap;

g. applying a bonding agent to said inner surface of said third belt;

h. sequentially winding said third belt onto said second spiral at substantially said second oblique angle for said bonding agent on said inner surface contacting said second spiral to define a third spiral thereon in which the longitudinal edges of said third spiral are in abutting contact;

i. sensing the position of one of the longitudinal edges of said third belt as the latter is wound onto said second spiral;

j. cutting a longitudinal segment from said third belt in response to said sensing that said third belt when defining said third sprial will be of uniform thickness and the adjacent edges of said third defining said third spiral will be in abutting contact;

k. applying radially directed pressure to said third spiral as said mandrel rotates to force said bonding agents into pressure contact with the adjacent surfaces of said first and second spirals and said second and third spirals;

1. moving said first, second, and third spirals as a unit longitudinally on said mandrel; and m. cutting said tubular member in desired lengths from said mandrel but cutting edges that move outwardly from the interior of said mandrel.

* * * * *